United States Patent [19]

Volke et al.

[11] Patent Number: 4,504,161

[45] Date of Patent: Mar. 12, 1985

[54] PRINTING AND TYPING APPARATUS FOR THE SELECTIVE PRINTING OF SINGLE SHEET OR MARGINALLY PERFORATED ENDLESS PAPER

[75] Inventors: Hans-Werner Volke, Salzkotten; Jürgen Hilkenmeier, Paderborn; Hermann Kohlhage, Paderborn; Udo Tewes, Paderbon, all of Fed. Rep. of Germany

[73] Assignee: Nixdorf Computer AG, Fed. Rep. of Germany

[21] Appl. No.: 430,082

[22] Filed: Sep. 30, 1982

[30] Foreign Application Priority Data

Apr. 20, 1982 [DE] Fed. Rep. of Germany ..... 3214531

[51] Int. Cl.[3] ..... B41J 11/00

[52] U.S. Cl. ..... 400/605; 400/625

[58] Field of Search ..... 400/605, 624, 625, 608.1

[56] References Cited

U.S. PATENT DOCUMENTS 3,753,483 8/1973 Lundquist et al. ..... 400/605

4,280,693 7/1981 Matsuhisa et al. ..... 400/624

FOREIGN PATENT DOCUMENTS 56-42673 4/1981 Japan ..... 400/625

WO82/03823 11/1982 PCT Int'l Appl. ..... 400/605

OTHER PUBLICATIONS

Mott et al., "Cover Section for . . . printer", IBM Technical Disclosure Bulletin, vol. 24, No. 8, p. 4348, 1/82.

*Primary Examiner*—William Pieprz

*Attorney, Agent, or Firm*—Krass & Young

[57] ABSTRACT

Printing or recording apparatus for the selective printing of single sheets or margin-perforated endless paper in which for the endless paper operation a separate conveying unit can be put in place on the printer housing which unit is provided with conveying means engaging in the perforated margin of the endless paper. The sight case of the conveying unit is arranged over the feed opening as well as the delivery unit for the single sheets. A movable lid permits access to these openings for the single-sheet operation but covers these completely and in a soundproofing way for endless paper operation. Connected with the movable lid there is a prop which in the closed position of the lid automatically lifts off the platen the feed rolls not required in this operating state.

5 Claims, 2 Drawing Figures

PRINTING AND TYPING APPARATUS FOR THE SELECTIVE PRINTING OF SINGLE SHEET OR MARGINALLY PERFORATED ENDLESS PAPER

DESCRIPTION

Introduction

The invention relates to a printing or recording apparatus for the selective printing of single sheets or margin-perforated endless paper, with feed and delivery openings formed on the top of the printer housing for single sheets as well as a separate feed opening for the endless paper, including a platen as well as feed rolls cooperating with it which are arranged on roll carriers and can be lifted off of the platen for endless paper operation, as well as including a conveying unit which can be placed on the printer housing with conveying means arranged in a sight case and engaging in the marginal perforations of the endless paper.

BACKGROUND OF THE INVENTION

This type of printers used for operation with both kinds of paper have been very inadequate up to now. They are very loud, particularly during the endless paper operation, since on the one hand the noise of the printing mechanism comes out through the openings arranged on the top side of the printer housing, and since on the other hand the noise of the conveying unit as well as of the paper, which tends to chatter especially in rapid printer operation, penetrate to the outside. For this reason the openings not required each time must be especially covered. Besides this, for endless paper operation the feed rolls not required for the conveying of the paper must be lifted off. For this reason the reconversion of the printing apparatus for one or the other mode of operation is very expensive. Besides this, there is the possibility of an erroneous servicing of the apparatus, since nothing can be seen from the outside as to which mode of operation the printing apparatus is currently situated in.

SUMMARY OF THE INVENTION

It is the task of the present invention to create a printing apparatus of the type mentioned at the start in which the conversion from one mode of operation to the other is highly simplified and in which a good blocking off sound is achieved with the simplest means.

This problem is solved according to the invention by having the sight case put in place cover over the feed and delivery openings of the printer housing for the single sheets, where a recess situated in the bottom side of the sight case is covered over with the feed and delivery openings, by having an opening formed on the top side of the sight case which permits access to the conveying means, provided with a lid adjustable between an open position and a closed position, and by having operating apparatus arranged on the lid which cooperate with the roll carriers and lift these from the platen in the closed position of the lid.

For resetting the apparatus for endless paper operation, the conveying unit is put in place, thus in an intrinsically known manner automatically creating a driving connection between the roll drive and the conveying means. Because the lid is still in the open position, the feed rolls are still lying against the platen, so that the introduction of the paper can be reinforced by operating the platen. The conveying unit is still accessible through the opening, which is not yet covered over, in the top side of the sight case, so that the paper can be laid in the conveying means, generally in the burled strip engaging in the marginal perforation of the endless paper. By closing the lid, the feed and delivery openings formed on the top side of the printer housing as well as the sight case itself are both closed at the same time, so that both the noise of the printing mechanism and that of the conveying unit are effectively damped. At the same time the feed rolls which are no longer needed for the endless paper are automatically lifted off. In this configuration no single sheet operation is possible, since the feed and delivery openings in the top side of the printer housing are not accessible.

For single-sheet operation the lid is merely pushed back far enough so that the feed and delivery openings in the top side of the printer housing become free. Thereby at the same time the operating apparaus becomes disengaged from the roll holder, so that the feed rolls again lie against the platen and take over the conveying of the paper.

In a preferred development of the invention the lid is designed as a simple slide plate movable in the direction of the lifting motion of the roll carrier and supported in the sight case, where the operating apparatus is formed by one or more props arranged on the lid and moving against the roll carrier during the closing motion of the lid.

In a further development of the invention, a flap or the like standing upright is arranged on the lid on its front edge near the feed and delivery openings of the printer housing, which in single-sheet operation serves as an abutment means for the paper.

The lid is preferably constructed of a transparent material, for example a plastic material, so that the orderly running of the paper in the conveying unit can be observed.

Further advantages and features are found in the patent claims.

One embodiment example of the invention is represented in the drawings and described in the following in detail.

DETAILED DESCRIPTION OF ILLUSTRATIVE EMBODIMENT

Figure 1:
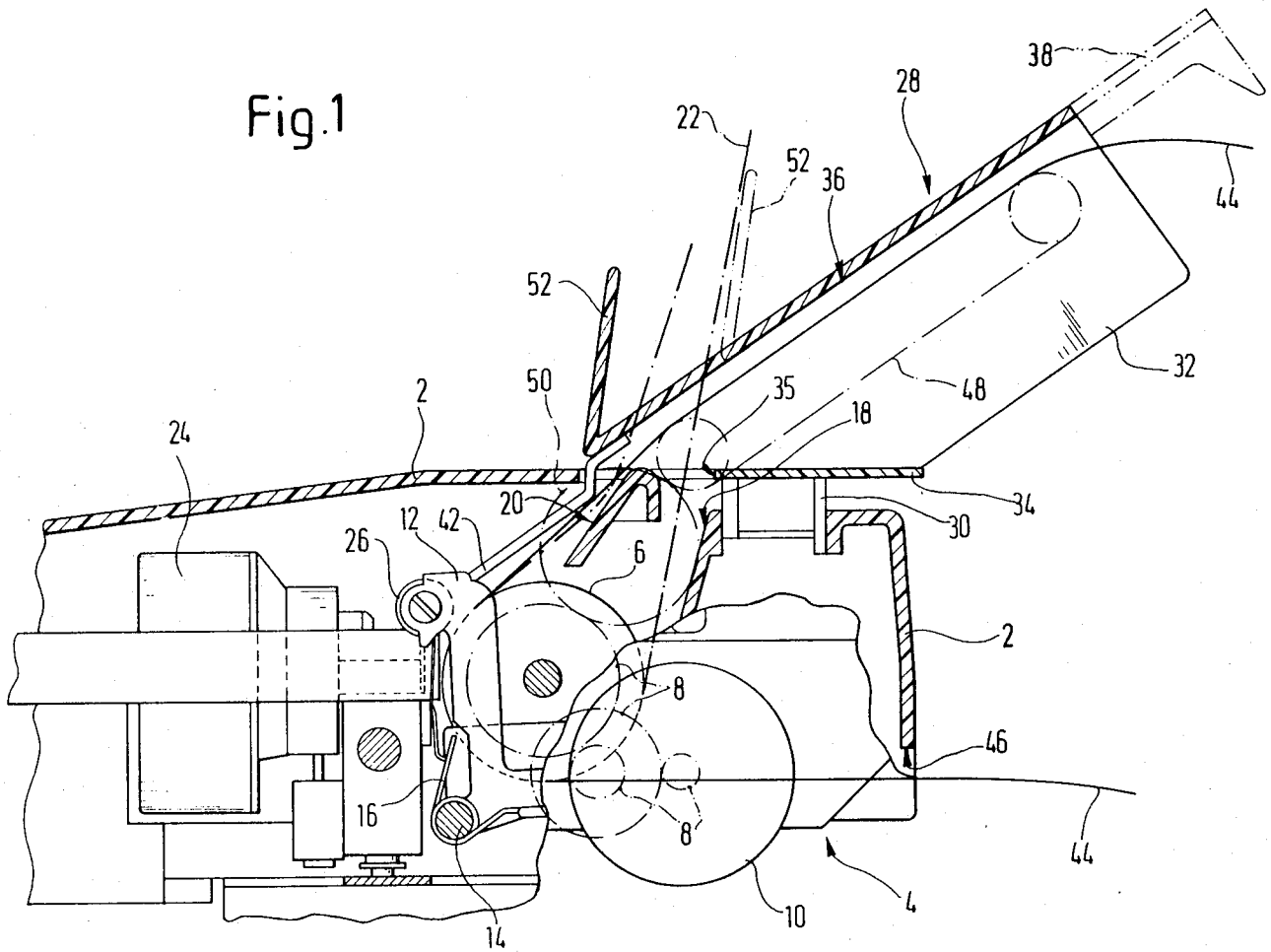
FIG. 1 in a partial longitudinal section shows a printing apparatus with sight case placed on it.

FIG. 1 shows a printer housing 2 with the printing mechanism 4 arranged in it. This substantially includes a platen 6 which is connected with a driving motor 10 by way of gears 8. A roll holder 12 is supported swiveling around an axis 14 and is pressed by a spring 16 against the platen 6. The printer housing 2 shows on its top side a feed opening 18 as well as a delivery opening 20 for a single sheet of paper 22. The single sheet of paper 22 is introduced through the feed opening 18, drawn in through the platen 6 in cooperation with feed rolls, not shown, fed through various conventional guide devices, which therefore are not represented, past the print head 24 to the feed rolls 26 held in the roll holder 12 and from there finally to the delivery opening 20. In the single-sheet operation the roll holder 12 rests against the platen 6.

For the endless paper operation, a conveying unit 28 is put in place on the printer housing 2 with simple push-on mountings 30 which engage in corresponding recesses of the printer housing 2. The sight case 32 of the conveying unit 28 covers the feed opening 18 and also the delivery opening 20 completely with its bottom side 34. The case 32 is constructed to be open on the upper side when viewed in the combination of FIG. 1. The opening is fitted with a slidable lid 38 preferably made of clear plastic and slidable relative to the casing 32 between a first closed position, shown by solid lines in FIG. 1, and a second open position, shown by broken lines in FIG. 1. In the second open position the lid 38 is displaced and upwardly and rearwardly sufficiently to permit the operator access to the openings 18 and 20 of the printer 2. For the endless paper operation the lid 38 is pushed into the closed position represented in solid lines, where it completely closes the openings situated in the upper side 36 of the sight case 32 and therewith also covers over the feed opening 18 as well as the delivery opening 20 in the printer housing. On the lid 38 is arranged at least one prop 42, which in the last phase of the closing motion of the lid 38 comes in contact with the roll holder 12 and lifts this off of the platen 6. In this manner the printer is prepared for endless paper operation. The endless paper 44 enters a feed opening 46 formed on the backside of the printer housing 2, is guided around the platen 6 to the delivery opening 20, through which it enters the sight case 32. The marginal perforations of the endless roll paper 44 are engaged by the tractor conveyor means 48 in conventional fashion. When operable the tractor conveyor means 48 pulls the paper 44 through the case 32.

For single-sheet operation it is sufficient to push the lid 38 back into the position represented in dot-dash lines. Thereby on the one hand the feed opening 18 as well as the delivery opening 20 become accessible, while on the other hand the roll holder 12 is automatically released, so that it is pressed by the spring 16 against the platen 6 and the conveying rolls 26 can again take over their conveying task.

The number 50 designates a gear which connects one of the gears 8 of the roll drive with the conveying means 48.

Figure 2:
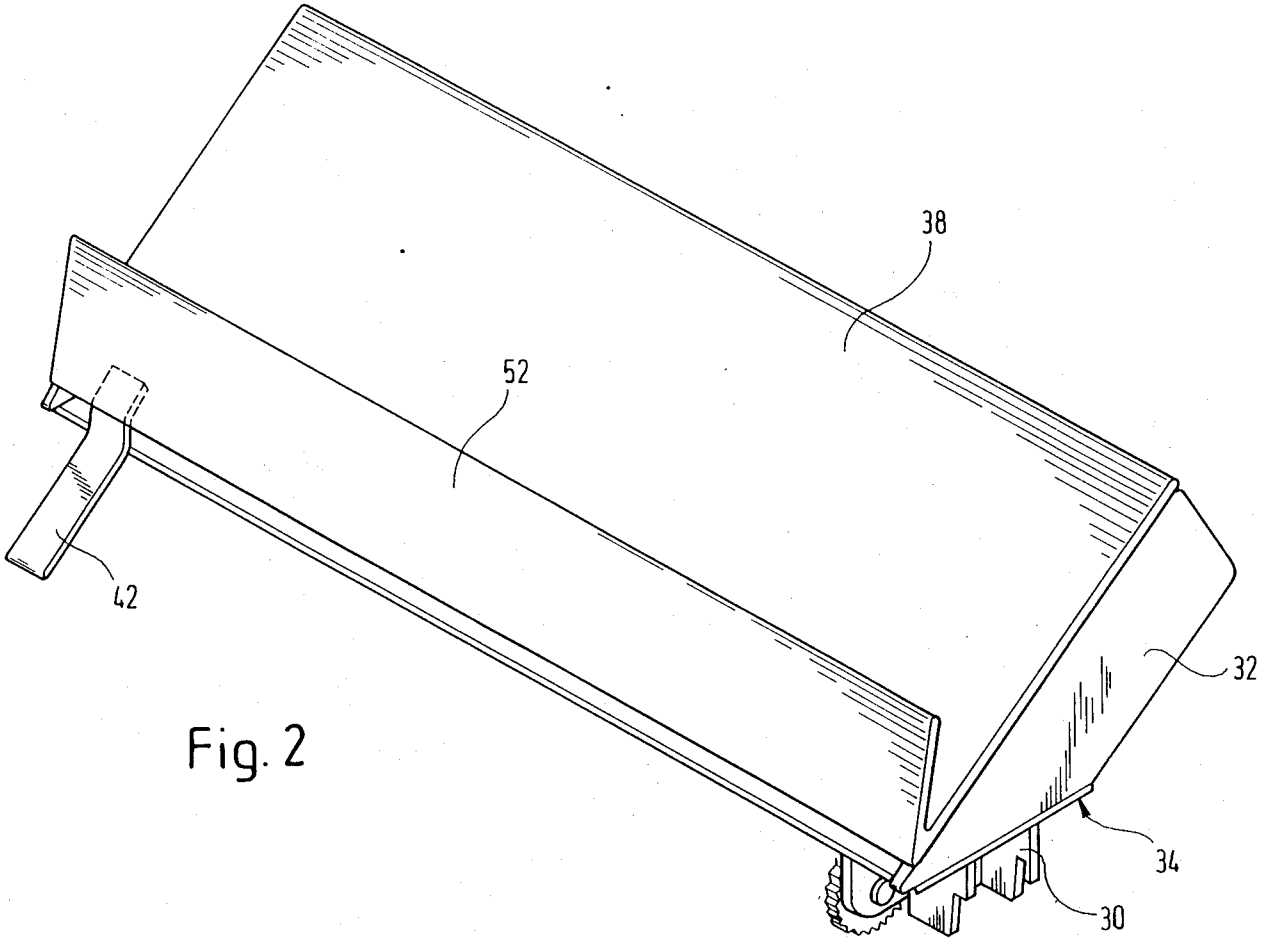
FIG. 2 shows a sight case in a perspective representation.

FIG. 2 in a perspective representation shows the sight case 32 with the push-on mountings 30 arranged on the bottom side 34 of the latter. The lid 38 is shown in its closed position. On the bottom side of the lid 38 is arranged the prop 42 which is bent downward at an angle so that it can come into engagement with the roll holder 12. In the embodiment example represented, only one prop 42 is shown; further props can be provided in order to avoid any tilting of the roll holder 12 when it is swung back.

On the lid 38 is formed a flap 52 standing upright on its front edge which in the position of the lid represented in dot-dash lines (see FIG. 1) serves as abutment means for the single sheet 22.

We claim:

1. For use in combination with a printer of the type which is used for single-sheet printing and which comprises a housing having in a top surface thereof adjacent single-sheet paper feed-in and feed-out openings, a separate feed-in opening for endless roll paper in another surface thereof a roller platen within the housing, and a tension roller mounted within the housing and biased into engagement with the platen but selectively pivotally displaceable away from the platen;

a device for selectively converting said printer from single-sheet-only operation to endless roll paper and single sheet multi-mode operation comprising:

a casing adapted to be placed on the printer housing and having an opening which is overlyingly coextensive with said single-sheet feed-in and feed-out openings of the printer;

endless roll paper tractor means carried by said casing for transporting endless roll paper from said endless roll opening, around said platen and through said single-sheet feed-out opening into said casing, said tractor means being driven from said platen when said casing is on said printer;

a lid mounted on the casing and slidable between a first position fully closing the casing and a second position permitting access into said casing and to said feed-in and feed-out printer openings;

means carried by said lid for mechanically extending into said printer housing and pivoting said tension roller away from said platen only when said lid is at least substantially in said first position;

and means for securing said casing to said housing, whereby opening said lid engages said tension roller with said platen and conditions said printer for single-sheet operation.

2. Apparatus as defined in claim 1 wherein said means for securing said casing to said housing comprises at least one aperture formed in said printer housing and anchor means formed on said casing and of such size and configuration as to enter into said aperture in said housing.

3. Apparatus as defined in claim 1 wherein said lid further comprises an integral turned-up flap along the extremity thereof which is next adjacent said printer housing when the lid is in said first position.

4. Apparatus as defined in claim 1 wherein said lid is made of clear plastic.

5. Apparatus as defined in claim 1 further including gearing mounted in said printer housing adjacent said single-sheet openings and driven by said platen, said gearing drivingly contacting said tractor means when said casing is secured to said printer housing.

* * * * *